US009009887B2

(12) United States Patent
Lo

(10) Patent No.: US 9,009,887 B2
(45) Date of Patent: Apr. 21, 2015

(54) TRAVEL COT

(71) Applicant: Feng-Jun Lo, Tainan (TW)

(72) Inventor: Feng-Jun Lo, Tainan (TW)

(73) Assignee: Delsun Co., Ltd., Tainan (TW)

( * ) Notice: Subject to any disclaimer, the term of this patent is extended or adjusted under 35 U.S.C. 154(b) by 121 days.

(21) Appl. No.: 13/936,267

(22) Filed: Jul. 8, 2013

(65) Prior Publication Data

US 2015/0007387 A1 Jan. 8, 2015

(51) Int. Cl.
*A47D 13/06* (2006.01)
*A47D 9/00* (2006.01)

(52) U.S. Cl.
CPC ..... *A47D 9/005* (2013.01)

(58) Field of Classification Search
USPC ..... 5/99.1, 93.1, 98.1, 110, 111, 112, 114, 5/201, 200.1, 282.1, 285, 286, 288
See application file for complete search history.

(56) References Cited

U.S. PATENT DOCUMENTS

| | | | | | |
|---|---|---|---|---|---|
| 778,539 | A * | 12/1904 | Hamilton | 5/315.1 |
| 1,574,659 | A * | 2/1926 | Johnston | 5/288 |
| 1,660,394 | A * | 2/1928 | Patterson | 5/88.1 |
| 4,219,896 | A * | 9/1980 | Behel | 5/114 |
| 4,679,261 | A * | 7/1987 | Stanley et al. | 5/183 |
| 4,934,025 | A * | 6/1990 | Mariol | 16/347 |
| 5,241,717 | A * | 9/1993 | Ward et al. | 5/201 |
| 5,265,289 | A * | 11/1993 | Swiger et al. | 5/111 |
| 5,542,151 | A * | 8/1996 | Stranski et al. | 16/326 |
| 5,596,776 | A * | 1/1997 | Huang | 5/426 |
| 5,761,754 | A * | 6/1998 | Cheng | 5/99.1 |
| 6,079,064 | A * | 6/2000 | Hsieh | 5/114 |
| 6,701,548 | B2 * | 3/2004 | Vigneron | 5/110 |
| 7,272,865 | B2 * | 9/2007 | Le Gette et al. | 5/129 |
| 8,015,759 | B1 * | 9/2011 | Bruce | 52/146 |
| 2001/0013145 | A1 * | 8/2001 | Elliott et al. | 5/110 |
| 2006/0102822 | A1 * | 5/2006 | Liang | 248/514 |
| 2008/0271244 | A1 * | 11/2008 | Bergkvist | 5/99.1 |
| 2014/0075670 | A1 * | 3/2014 | Crumrine | 5/99.1 |

* cited by examiner

*Primary Examiner* — Robert G Santos
*Assistant Examiner* — Ifeolu Adeboyejo
(74) *Attorney, Agent, or Firm* — Alan D. Kamrath; Kamrath IP Lawfirm, P.A.

(57) ABSTRACT

A travel cot includes a frame unit, and two articulation units. The frame unit includes four corner blocks, four support legs, four elastic plates, two first connecting bars, and four second connecting bars. Each of the articulation units includes a positioning plate, a clamping plate, a movable plate, at least one positioning ball, at least one compression spring, a pivot shaft, and a hooked piece. Thus, the hooked piece of each of the articulation units is hooked on the clamping plate and the movable plate to limit the bending direction of the second connecting bars, so that the second connecting bars can only be pivoted upward and cannot be pivoted downward by limit of the hooked piece to prevent the second connecting bars from being bent downward and injuring the infant or baby.

10 Claims, 11 Drawing Sheets

TRAVEL COT

BACKGROUND OF THE INVENTION

1. Field of the Invention

The present invention relates to a cot and, more particularly, to a foldable travel cot for infants.

2. Description of the Related Art

A conventional travel cot comprises a framework and two joints. The framework includes two U-shaped linkages pivotally connected by the joints. The joints are located between the U-shaped linkages of the framework so that the U-shaped linkages of the framework are pivoted about the joints so as to expand or fold the framework. The joints are locked by locking mechanisms. After the joints are unlocked from the locking mechanisms, the U-shaped linkages of the framework are pressed and pivoted downward about the joints to abut each other so as to fold the framework. However, when the locking mechanisms are inoperative or fail, the U-shaped linkages of the framework are pivoted downward unintentionally, so that the infant is easily clamped between and hurt by the U-shaped linkages of the framework, thereby causing danger to the infant.

BRIEF SUMMARY OF THE INVENTION

In accordance with the present invention, there is provided a travel cot, comprising a frame unit, and two articulation units. The frame unit includes four corner blocks, four support legs, four elastic plates, two first connecting bars, and four second connecting bars. Each of the corner blocks of the frame unit is provided with two side sleeves and a lower sleeve. The lower sleeve of each of the corner blocks is provided with a mounting hole. Each of the support legs of the frame unit is inserted into the lower sleeve of the respective corner block and is provided with a fixing hole. Each of the elastic plates of the frame unit is received in the respective support leg and has a side provided with a fixing boss which extends through the fixing hole of the respective support leg and protrudes outward from the mounting hole of the lower sleeve of the respective corner block. Each of the first connecting bars of the frame unit has two opposite ends each inserted into the respective side sleeve of the respective corner block. Each of the second connecting bars of the frame unit has a first end inserted into the respective side sleeve of the respective corner block and a second end connected with the respective articulation unit. Thus, two of the corner blocks, one of the first connecting bars and two of the second connecting bars construct a substantially U-shaped linkage. Each of the articulation units includes a positioning plate, a clamping plate, a movable plate, at least one positioning ball, at least one compression spring, a pivot shaft, and a hooked piece. The positioning plate of each of the articulation units is fixedly connected with the respective second connecting bar of the frame unit and is provided with at least one through hole. The clamping plate of each of the articulation units abuts the positioning plate and is provided with at least one mounting stud inserted into the through hole of the positioning plate. The mounting stud of each of the articulation units has an interior provided with a receiving hole. The movable plate of each of the articulation units is fixedly connected with the respective second connecting bar of the frame unit and abuts the clamping plate. The movable plate of each of the articulation units is provided with at least one positioning hole. The positioning ball of each of the articulation units is received in the receiving hole of the mounting stud and is positioned in the positioning hole of the movable plate. The compression spring of each of the articulation units is received in the receiving hole of the mounting stud and is biased between the mounting stud of the clamping plate and the positioning ball to push the positioning ball toward the positioning hole of the movable plate. The pivot shaft of each of the articulation units is extended through the positioning plate, the clamping plate and the movable plate to combine the positioning plate, the clamping plate and the movable plate. The hooked piece of each of the articulation units is secured on and protruded outward from an upper end of the positioning plate. The hooked piece of each of the articulation units is located above and hooked on the clamping plate and the movable plate.

The primary objective of the present invention is to provide a travel cot, wherein the bending direction of each of the articulation units is limited to prevent the infant being clamped or injured by the articulation units.

According to the primary advantage of the present invention, the hooked piece of each of the articulation units is hooked on the protruding portion of the clamping plate and the movable plate to limit the bending direction of the second connecting bars, so that the second connecting bars can only be pivoted upward and cannot be pivoted downward by limit of the hooked piece of each of the articulation units so as to prevent the second connecting bars from being bent downward and injuring the infant or baby.

According to another advantage of the present invention, the two U-shaped linkages of the frame unit are asymmetric so that when the second connecting bars of the frame unit are folded, two laminating second connecting bars deflect a determined angle, such that when two corner blocks are laminated, the engaging recess of one of the two corner blocks engages the engaging recess of the other one of the two corner blocks so as to reduce the volume of the folded frame unit.

According to a further advantage of the present invention, each of the support legs of the frame unit is inclined outward with a determined inclined angle so that the frame unit is supported solidly and stably.

According to a further advantage of the present invention, each of the support legs of the frame unit is assembled and disassembled easily and quickly.

According to a further advantage of the present invention, the covering unit is assembled and disassembled easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
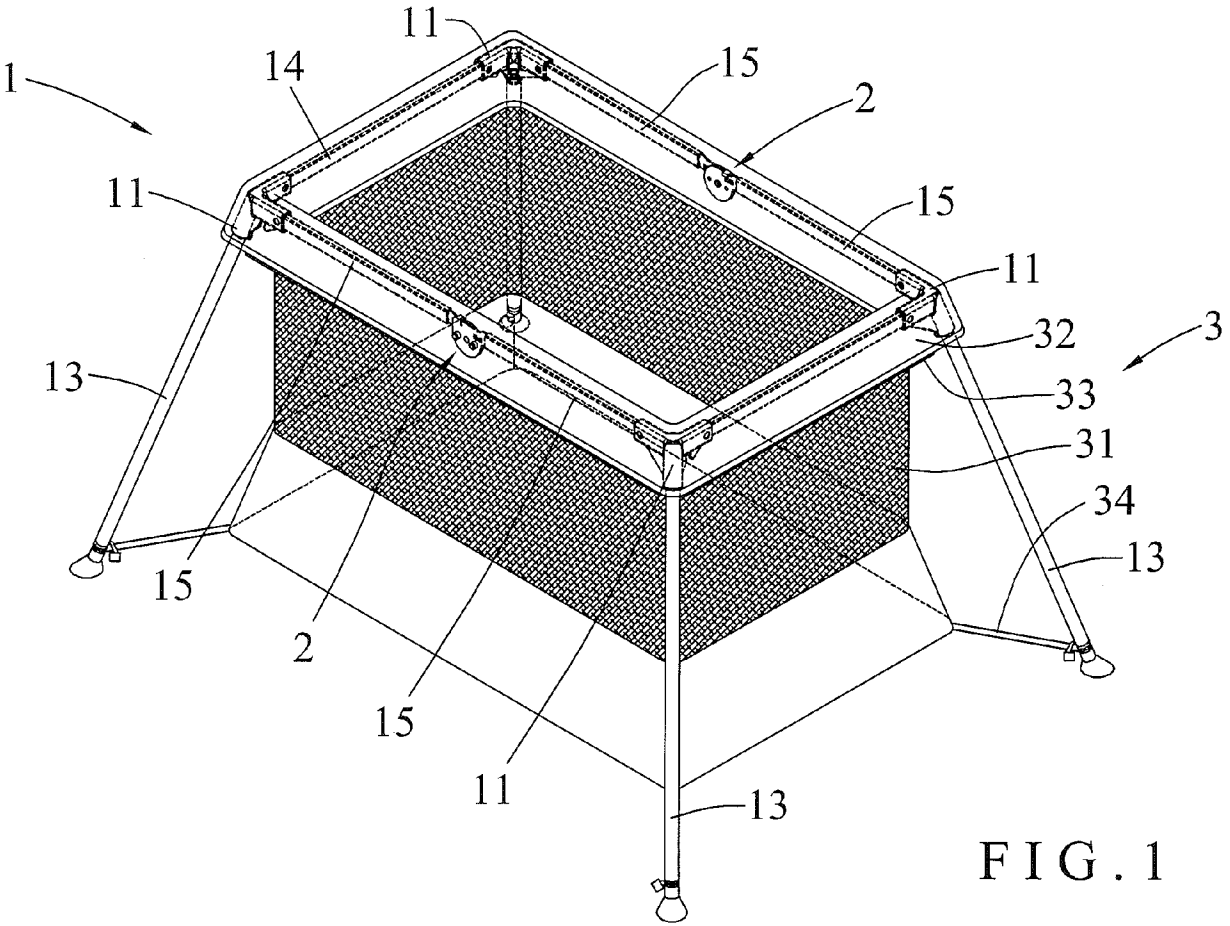
FIG. 1 is a perspective view of a travel cot in accordance with the preferred embodiment of the present invention.

Referring to the drawings and initially to FIGS. 1-8, a travel cot in accordance with the preferred embodiment of the present invention comprises a frame unit 1, two articulation units 2, and a covering unit 3.

The frame unit 1 includes four corner blocks 11, four support legs 13, four elastic plates 12, two first connecting bars 14, and four second connecting bars 15.

Each of the corner blocks 11 of the frame unit 1 is provided with two side sleeves 111 and a lower sleeve 112. The side sleeves 111 of each of the corner blocks 11 have an included angle defined therebetween of about ninety degrees (90°). Each of the side sleeves 111 of each of the corner blocks 11 is extended in a horizontal direction and is connected with the respective first connecting bar 14 or the respective second connecting bar 15. The lower sleeve 112 of each of the corner blocks 11 is extended downward and is provided with a mounting hole 115. The lower sleeve 112 of each of the corner blocks 11 has an interior provided with a slideway 116 connected to the mounting hole 115.

Each of the support legs 13 of the frame unit 1 is inserted into the lower sleeve 112 of the respective corner block 11 and is provided with a fixing hole 131. Each of the support legs 13 of the frame unit 1 is slidable in the slideway 116 of the lower sleeve 112. The lower sleeve 112 of each of the corner blocks 11 is inclined outward with a determined inclined angle so that each of the support legs 13 of the frame unit 1 is also inclined outward with a determined inclined angle.

Each of the elastic plates 12 of the frame unit 1 is received in the respective support leg 13 and has a side provided with a fixing boss 121 which extends through the fixing hole 131 of the respective support leg 13 and protrudes outward from the mounting hole 115 of the lower sleeve 112 of the respective corner block 11.

Each of the first connecting bars 14 of the frame unit 1 is located between two of the corner blocks 11 and has two opposite ends each inserted into the respective side sleeve 111 of the respective corner block 11.

Figure 10:
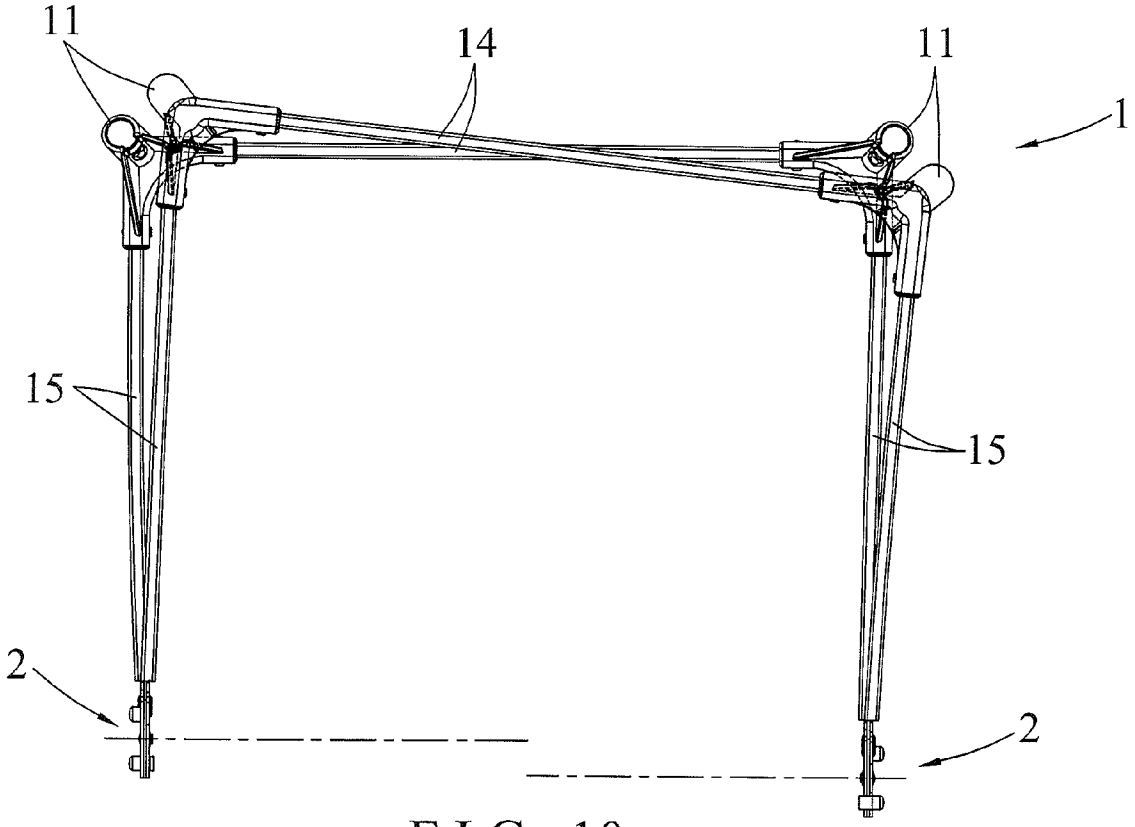
FIG. 10 is a schematic side folded view of the frame unit of the travel cot as shown in FIG. 2.

Each of the second connecting bars 15 of the frame unit 1 has a first end inserted into the respective side sleeve 111 of the respective corner block 11 and a second end connected with the respective articulation unit 2. Thus, two of the corner blocks 11, one of the first connecting bars 14 and two of the second connecting bars 15 construct a substantially U-shaped linkage. The frame unit 1 includes two U-shaped linkages. The two U-shaped linkages of the frame unit 1 are asymmetric about the articulation units 2 as shown in FIG. 10.

Figure 11:
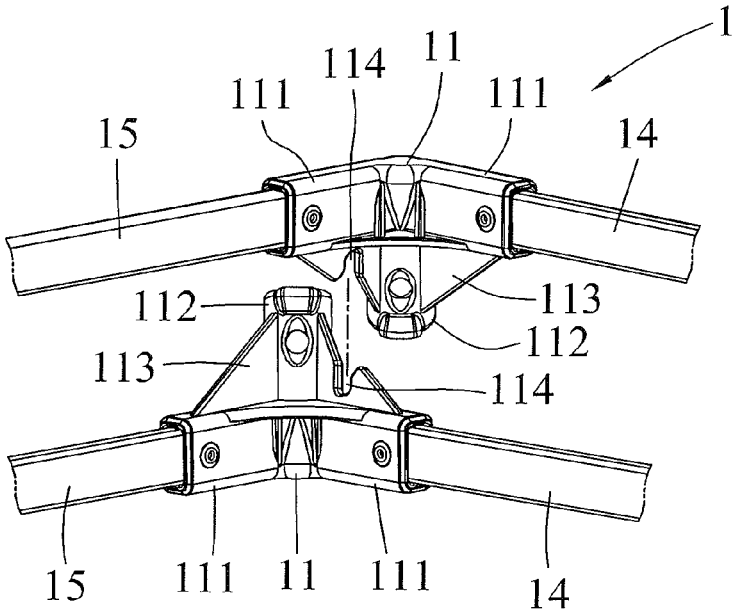
FIG. 11 is a perspective folded view of the frame unit of the travel cot as shown in FIG. 2.
Figure 12:
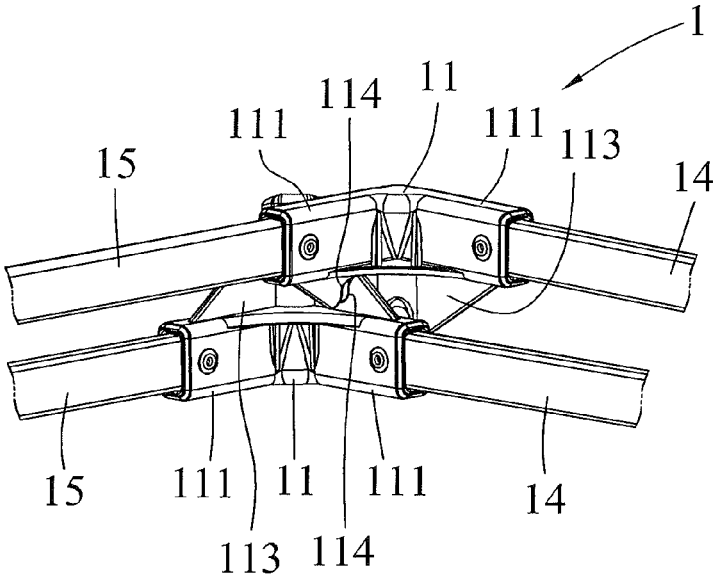
FIG. 12 is a schematic operational view of the frame unit of the travel cot as shown in FIG. 11.

The frame unit 1 further includes a plurality of reinforcing ribs 113 formed between the side sleeves 111 of each of the corner blocks 11 and between the lower sleeve 112 and each of the side sleeves 111 of each of the corner blocks 11. One of the reinforcing ribs 113 located between the lower sleeve 112 and one of the side sleeves 111 of each of the corner blocks 11 is provided with an engaging recess 114. The connections of the second connecting bars 15 of the frame unit 1 and the articulation units 2 at two opposite sides of the travel cot are asymmetric. Thus, when the second connecting bars 15 of the frame unit 1 and the articulation units 2 are folded, two laminating second connecting bars 15 deflect a determined angle as shown in FIG. 10, so that when two corner blocks 11 are laminated as shown in FIG. 11, the engaging recess 114 of one of the two corner blocks 11 engages the engaging recess 114 of the other one of the two corner blocks 11 as shown in FIG. 12.

The articulation units 2 are located between the U-shaped linkages of the frame unit 1 to connect the U-shaped linkages of the frame unit 1. Each of the articulation units 2 is located between two of the second connecting bars 15 of the frame unit 1 and includes a positioning plate 21, a clamping plate 23, a movable plate 26, at least one positioning ball 25, at least one compression spring 24, a pivot shaft 28, and a hooked piece 22.

The positioning plate 21 of each of the articulation units 2 is fixedly connected with the respective second connecting bar 15 of the frame unit 1. The positioning plate 21 of each of the articulation units 2 is provided with at least one through hole 211.

The clamping plate 23 of each of the articulation units 2 is sandwiched between the positioning plate 21 and the movable plate 26 and abuts the positioning plate 21. The clamping plate 23 of each of the articulation units 2 is provided with at least one mounting stud 232 inserted into the through hole 211 of the positioning plate 21. The mounting stud 232 of each of the articulation units 2 aligns with the through hole 211 of the positioning plate 21 and has an interior provided with a receiving hole 233. The clamping plate 23 of each of the articulation units 2 is provided with a protruding portion 231 extending outward.

The movable plate 26 of each of the articulation units 2 is fixedly connected with the respective second connecting bar 15 of the frame unit 1 and abuts the clamping plate 23. The movable plate 26 of each of the articulation units 2 is provided with at least one positioning hole 27 which has a diameter smaller that of the positioning ball 25. The positioning hole 27 of the movable plate 26 of each of the articulation units 2 aligns with the receiving hole 233 of the mounting stud 232.

The positioning ball 25 of each of the articulation units 2 is received in the receiving hole 233 of the mounting stud 232 and is positioned in the positioning hole 27 of the movable plate 26.

The compression spring 24 of each of the articulation units 2 is received in the receiving hole 233 of the mounting stud 232 and is biased between the mounting stud 232 of the clamping plate 23 and the positioning ball 25 to push the positioning ball 25 toward the positioning hole 27 of the movable plate 26.

The pivot shaft 28 of each of the articulation units 2 is extended through the positioning plate 21, the clamping plate 23 and the movable plate 26 to combine the positioning plate 21, the clamping plate 23 and the movable plate 26.

The hooked piece 22 of each of the articulation units 2 is secured on and protruded outward from an upper end of the positioning plate 21. The hooked piece 22 of each of the articulation units 2 is located above and hooked on the clamping plate 23 and the movable plate 26. The hooked piece 22 of each of the articulation units 2 is preferably hooked on the protruding portion 231 of the clamping plate 23.

The covering unit 3 is mounted on the frame unit 1 and includes a cloth enclosure 31 enclosed in the frame unit 1, a brim 32 mounted on an upper end of the cloth enclosure 31, a zipper 33 mounted on a distal end of the brim 32, and four binding cords 34 mounted on a lower end of the cloth enclosure 31 and connected with the support legs 13 of the frame unit 1.

Figure 2:
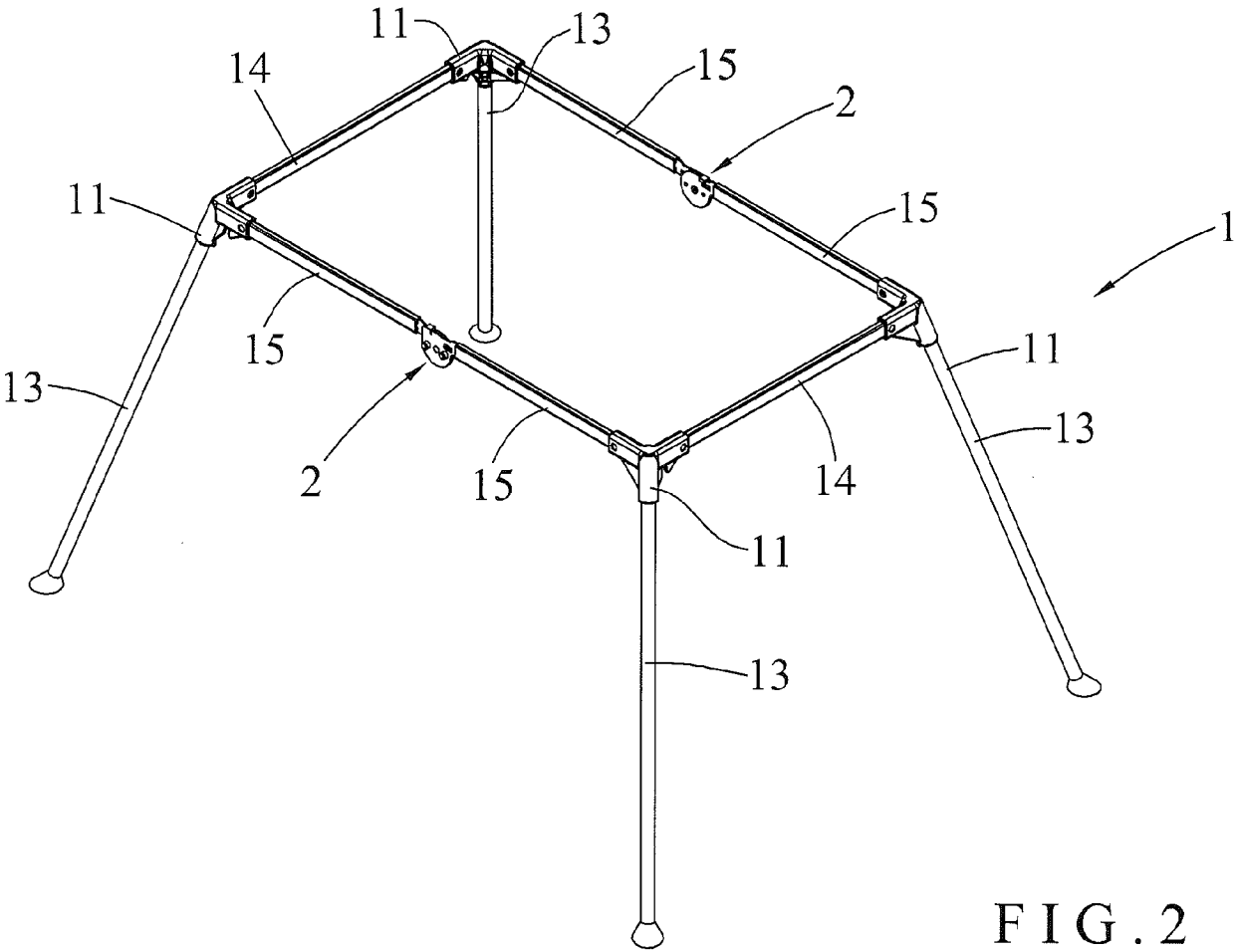
FIG. 2 is a partially perspective view of the travel cot as shown in FIG. 1.
Figure 3:
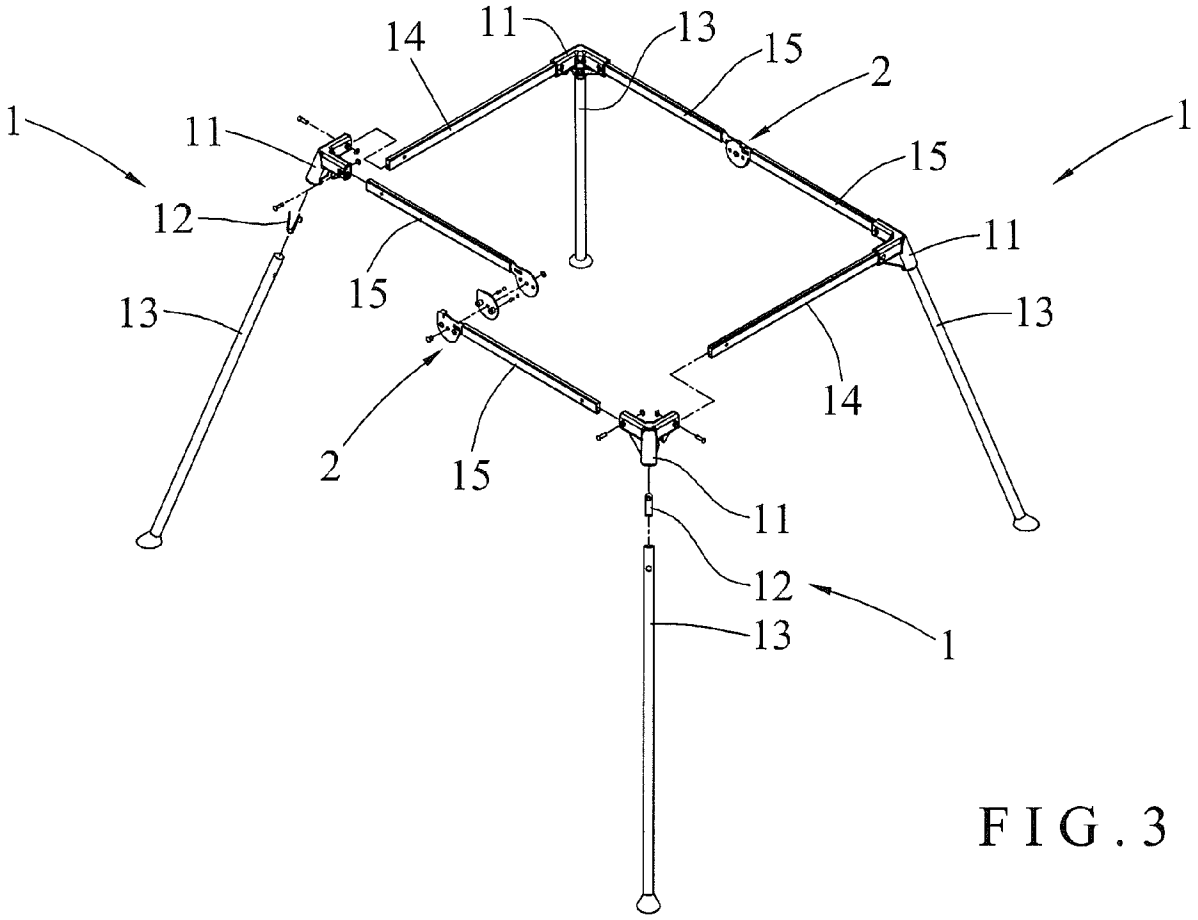
FIG. 3 is a partially exploded perspective view of the travel cot as shown in FIG. 2.
Figure 4:
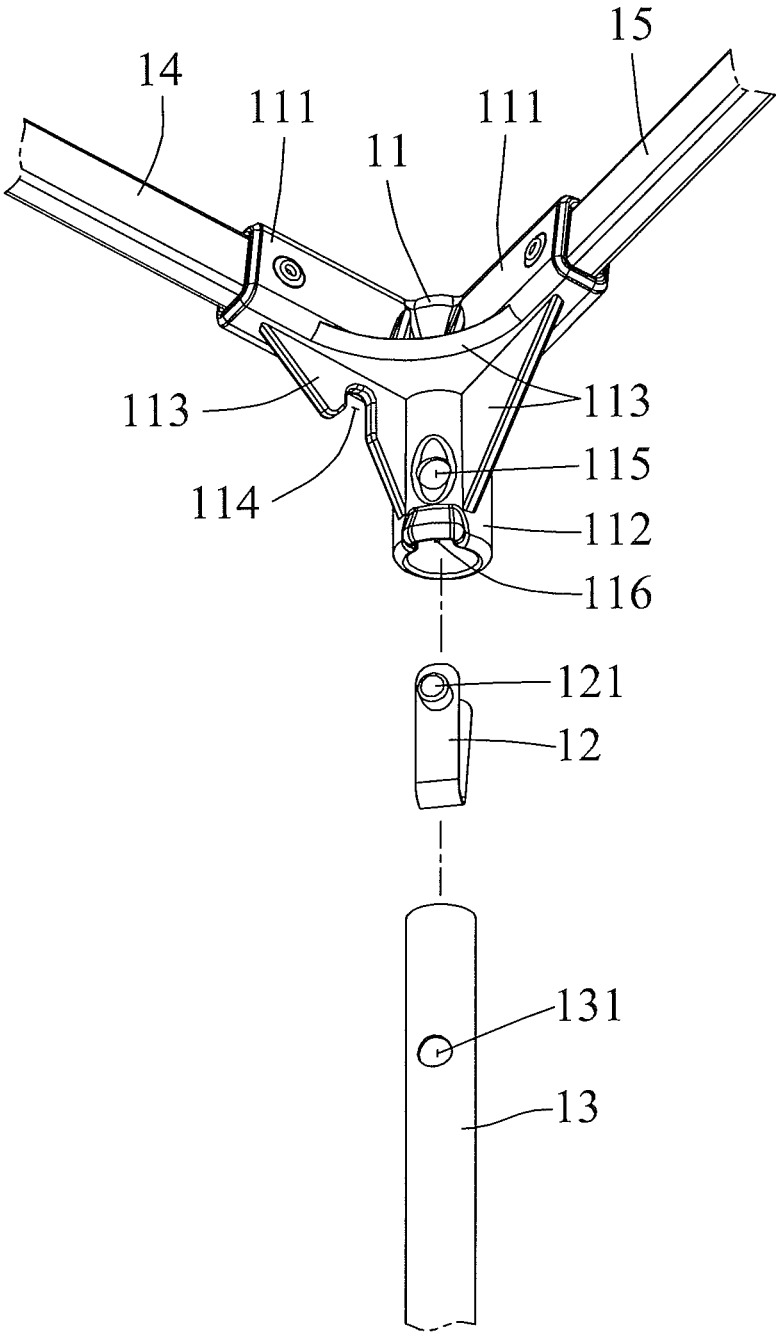
FIG. 4 is a partially exploded perspective view of a frame unit of the travel cot as shown in FIG. 2.

In assembly, each of the elastic plates 12 of the frame unit 1 is received in the respective support leg 13, with the fixing boss 121 extending through the fixing hole 131 of the respective support leg 13. Then, each of the support legs 13 of the frame unit 1 is inserted into the slideway 116 of the lower sleeve 112 of the respective corner block 11. When the fixing boss 121 of each of the elastic plates 12 aligns with the mounting hole 115 of the lower sleeve 112 of the respective corner block 11, the fixing boss 121 of each of the elastic plates 12 springs and protrudes outward from the mounting hole 115 of the lower sleeve 112 of the respective corner block 11. Thus, the support legs 13 and the corner blocks 11 are combined together. Then, the mounting stud 232 of each of the articulation units 2 is inserted into the through hole 211 of the positioning plate 21 until the clamping plate 23 abuts the positioning plate 21. Then, the compression spring 24 and the positioning ball 25 of each of the articulation units 2 is received in the receiving hole 233 of the mounting stud 232. Then, the movable plate 26 of each of the articulation units 2 abuts the clamping plate 23, with the positioning ball 25 being positioned in the positioning hole 27 of the movable plate 26. Then, the pivot shaft 28 of each of the articulation units 2 is in turn extended through the positioning plate 21, the clamping plate 23 and the movable plate 26 to combine the positioning plate 21, the clamping plate 23 and the movable plate 26. At this time, the second connecting bars 15 of the frame unit 1 are disposed at a horizontal state, and the hooked piece 22 of each of the articulation units 2 is located above and hooked on the protruding portion 231 of the clamping plate 23 and the movable plate 26 to limit the bending direction of the second connecting bars 15. Thus, the second connecting bars 15 can be pivoted upward and cannot be pivoted downward by limit of the hooked piece 22 of each of the articulation units 2 so as to prevent the second connecting bars 15 from being bent downward and injuring the infant or baby. Then, each of the two opposite ends of each of the first connecting bars 14 of the frame unit 1 is inserted into the respective side sleeve 111 of the respective corner block 11. Then, the first end of each of the second connecting bars 15 of the frame unit 1 is inserted into the respective side sleeve 111 of the respective corner block 11. Thus, the frame unit 1 and the articulation units 2 are combined together as shown in FIG. 2. Then, the cloth enclosure 31 of the covering unit 3 is enclosed in the frame unit 1, with the brim 32 surrounding the first connecting bars 14 and the second connecting bars 15 of the frame unit 1. Then, the brim 32 and the cloth enclosure 31 of the covering unit 3 are combined by the zipper 33. Finally, the binding cords 34 of the covering unit 3 are tied to the support legs 13 of the frame unit 1. Thus, the covering unit 3 is combined with the frame unit 1 to construct the travel cot as shown in FIG. 1.

Figure 5:
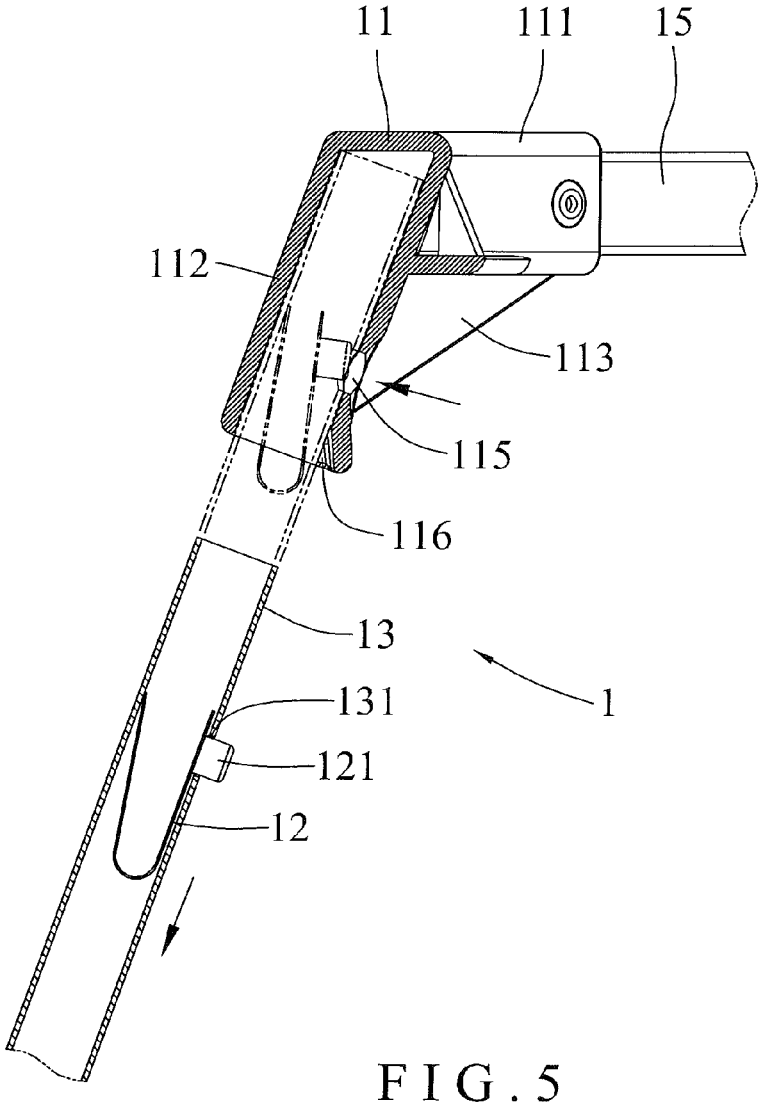
FIG. 5 is a partially exploded cross-sectional view of the frame unit of the travel cot as shown in FIG. 2.
Figure 6:
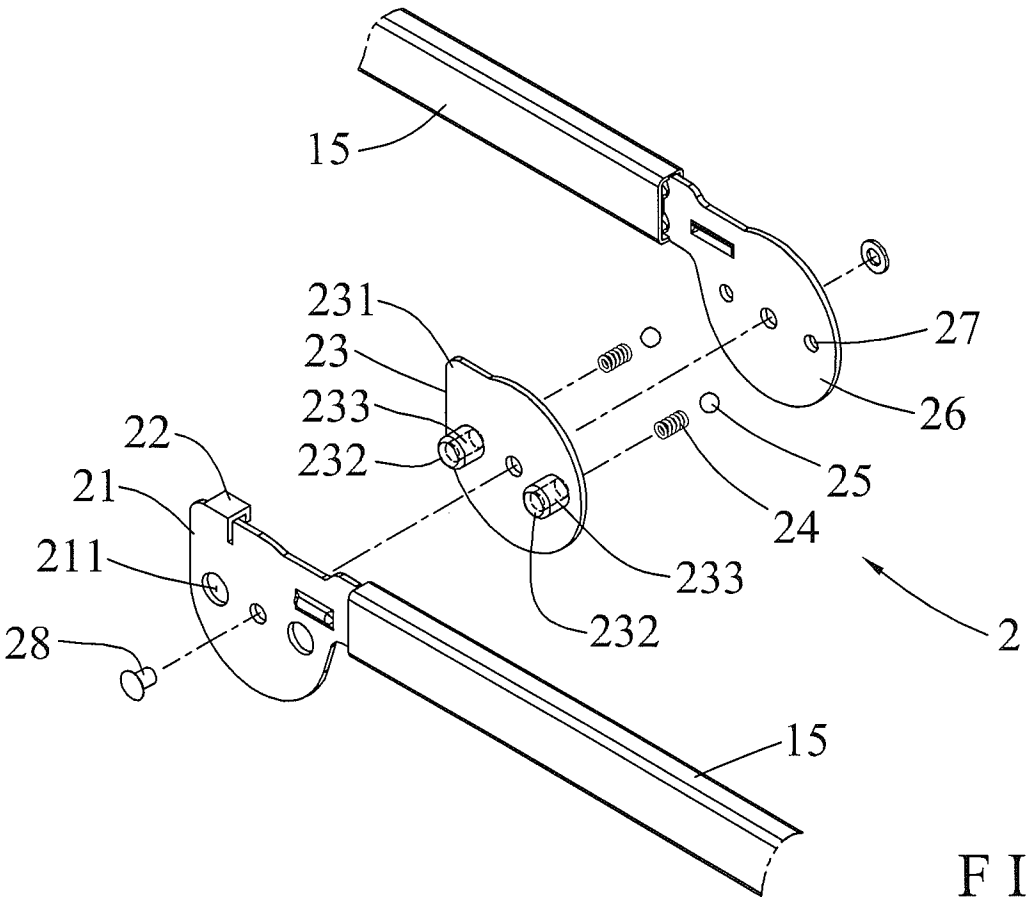
FIG. 6 is a partially exploded perspective view of an articulation unit of the travel cot as shown in FIG. 2.
Figure 7:
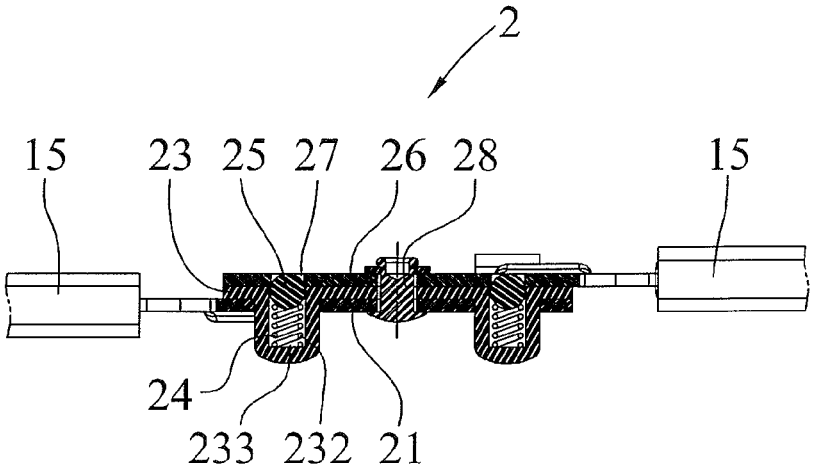
FIG. 7 is a cross-sectional assembly view of the articulation unit of the travel cot as shown in FIG. 6.
Figure 8:
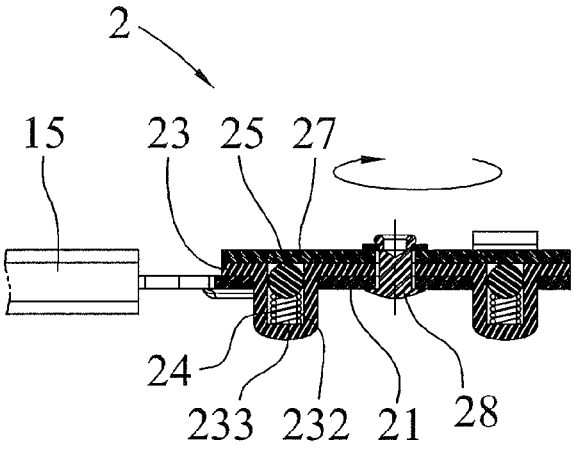
FIG. 8 is a schematic operational view of the travel cot as shown in FIG. 7.
Figure 9:
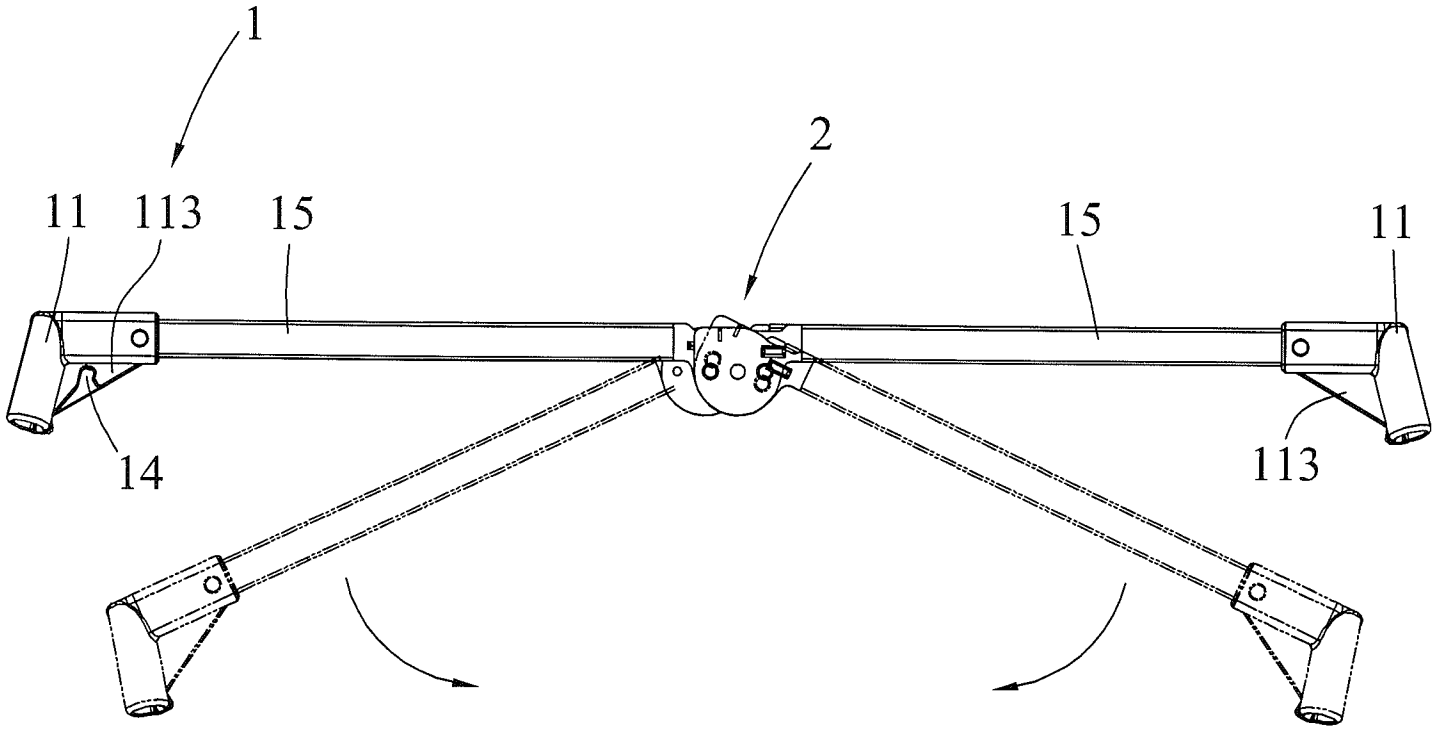
FIG. 9 is a schematic front operational view of the travel cot as shown in FIG. 2.
Figure 13:
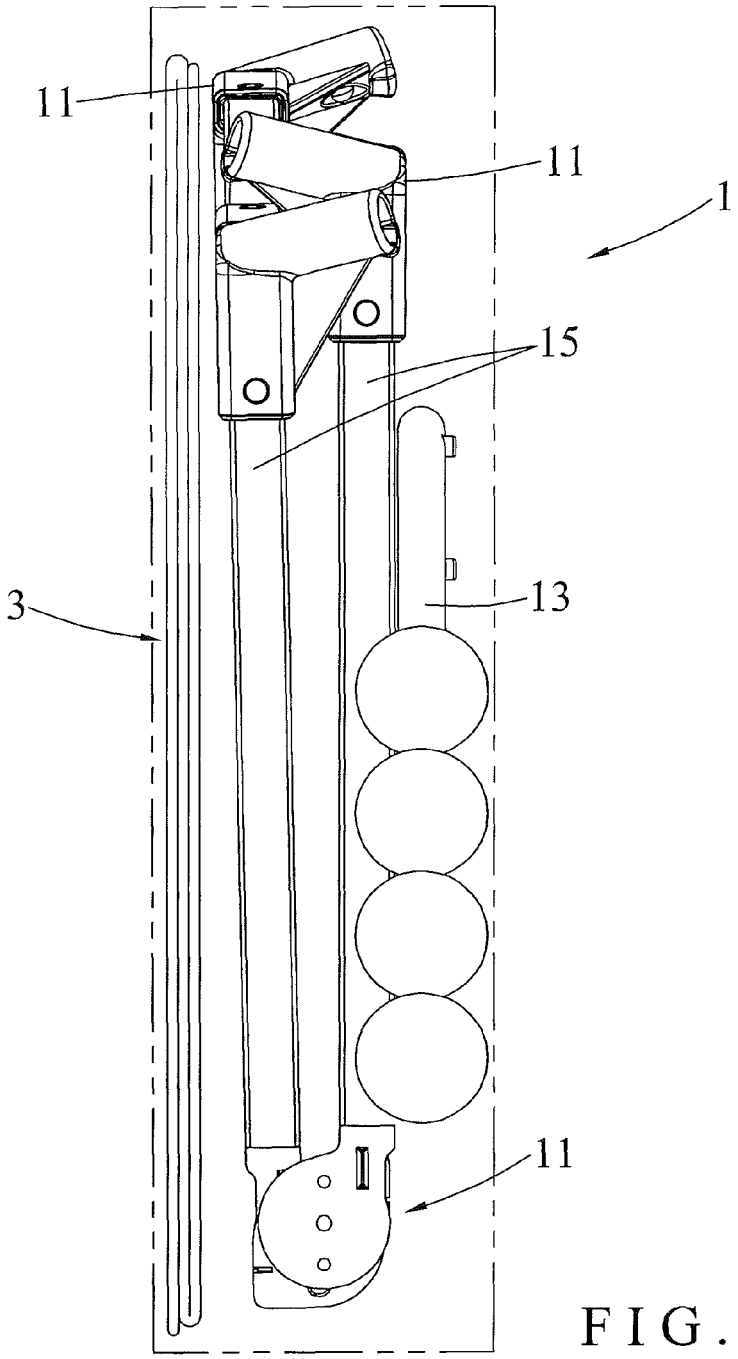
FIG. 13 is a schematic side folded view of the frame unit of the travel cot as shown in FIG. 10.

In folding operation of the travel cot, referring to FIGS. 8-13 with reference to FIGS. 1-7, the covering unit 3 is initially removed from the frame unit 1 to expose the frame unit 1 as shown in FIG. 2. Then, the fixing boss 121 of each of the elastic plates 12 is pressed inward to unlock each of the elastic plates 12 from the lower sleeve 112 of the respective corner block 11 so that each of the support legs 13 can be detached from the lower sleeve 112 of the respective corner block 11 as shown in FIG. 5. Then, the second connecting bars 15 of the frame unit 1 are pivoted downward relative to the articulation units 2 as shown in FIG. 9. At this time, the positioning ball 25 of each of the articulation units 2 is compressed by the movable plate 26 and is retracted into the receiving hole 233 of the mounting stud 232 as shown in FIG. 8. Then, the two U-shaped linkages of the frame unit 1 are pivoted about the articulation units 2 to move toward each other. At this time, the two U-shaped linkages of the frame unit 1 are asymmetric about the articulation units 2, and the connections of the second connecting bars 15 of the frame unit 1 and the articulation units 2 at two opposite sides of the travel cot are asymmetric as shown in FIG. 10. In such a manner, when the two U-shaped linkages of the frame unit 1 are pivoted toward each other to fold the second connecting bars 15 of the frame unit 1 and the articulation units 2, two laminating second connecting bars 15 deflect a determined angle as shown in FIG. 10, so that when two corner blocks 11 are laminated as shown in FIG. 11, the engaging recess 114 of one of the two corner blocks 11 engages the engaging recess 114 of the other one of the two corner blocks 11 as shown in FIG. 12. Thus, the frame unit 1 is folded completely as shown in FIG. 13.

Accordingly, the hooked piece 22 of each of the articulation units 2 is hooked on the protruding portion 231 of the clamping plate 23 and the movable plate 26 to limit the bending direction of the second connecting bars 15, so that the second connecting bars 15 can only be pivoted upward as shown in FIG. 9 and cannot be pivoted downward by limit of the hooked piece 22 of each of the articulation units 2 so as to prevent the second connecting bars 15 from being bent downward and injuring the infant or baby. In addition, the two U-shaped linkages of the frame unit 1 are asymmetric so that when the second connecting bars 15 of the frame unit 1 are folded, two laminating second connecting bars 15 deflect a determined angle, such that when two corner blocks 11 are laminated, the engaging recess 114 of one of the two corner blocks 11 engages the engaging recess 114 of the other one of the two corner blocks 11 so as to reduce the volume of the folded frame unit 1. Further, each of the support legs 13 of the frame unit 1 is inclined outward with a determined inclined angle so that the frame unit 1 is supported solidly and stably. Further, each of the support legs 13 of the frame unit 1 is assembled and disassembled easily and quickly. Further, the covering unit 3 is assembled and disassembled easily and quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A travel cot, comprising:

a frame unit, and two articulation units; wherein:

the frame unit includes four corner blocks, four support legs, four elastic plates, two first connecting bars, and four second connecting bars;

each of the corner blocks of the frame unit is provided with two side sleeves and a lower sleeve;

the lower sleeve of each of the corner blocks is provided with a mounting hole;

each of the support legs of the frame unit is inserted into the lower sleeve of the respective corner block and is provided with a fixing hole;

each of the elastic plates of the frame unit is received in the respective support leg and has a side provided with a fixing boss which extends through the fixing hole of the respective support leg and protrudes outward from the mounting hole of the lower sleeve of the respective corner block;

each of the first connecting bars of the frame unit has two opposite ends each inserted into the respective side sleeve of the respective corner block;

each of the second connecting bars of the frame unit has a first end inserted into the respective side sleeve of the respective corner block and a second end connected with the respective articulation unit;

two of the corner blocks, one of the first connecting bars and two of the second connecting bars construct a substantially U-shaped linkage;

each of the articulation units includes a positioning plate, a clamping plate, a movable plate, at least one positioning ball, at least one compression spring, a pivot shaft, and a hooked piece;

the positioning plate of each of the articulation units is fixedly connected with the respective second connecting bar of the frame unit and is provided with at least one through hole;

the clamping plate of each of the articulation units abuts the positioning plate and is provided with at least one mounting stud inserted into the through hole of the positioning plate;

the mounting stud of each of the articulation units has an interior provided with a receiving hole;

the movable plate of each of the articulation units is fixedly connected with the respective second connecting bar of the frame unit and abuts the clamping plate;

the movable plate of each of the articulation units is provided with at least one positioning hole;

the positioning ball of each of the articulation units is received in the receiving hole of the mounting stud and is positioned in the positioning hole of the movable plate;

the compression spring of each of the articulation units is received in the receiving hole of the mounting stud and is biased between the mounting stud of the clamping plate and the positioning ball to push the positioning ball toward the positioning hole of the movable plate;

the pivot shaft of each of the articulation units is extended through the positioning plate, the clamping plate and the movable plate to combine the positioning plate, the clamping plate and the movable plate;

the hooked piece of each of the articulation units is secured on and protruded outward from an upper end of the positioning plate; and the hooked piece of each of the articulation units is located above and hooked on the clamping plate and the movable plate.

2. The travel cot of claim 1, wherein the side sleeves of each of the corner blocks have an included angle defined therebetween of about ninety degrees (90°).

3. The travel cot of claim 1, wherein:

the lower sleeve of each of the corner blocks is inclined outward with a determined inclined angle; and each of the support legs of the frame unit is inclined outward with a determined inclined angle.

4. The travel cot of claim 1, wherein the frame unit 1 further includes a plurality of reinforcing ribs formed between the side sleeves of each of the corner blocks and between the lower sleeve and each of the side sleeves of each of the corner blocks.

5. The travel cot of claim 4, wherein:

one of the reinforcing ribs located between the lower sleeve and one of the side sleeves of each of the corner blocks is provided with an engaging recess;

connections of the second connecting bars of the frame unit and the articulation units at two opposite sides of the travel cot are asymmetric;

when the second connecting bars of the frame unit and the articulation units are folded, two laminating second connecting bars deflect a determined angle; and when two corner blocks are laminated, the engaging recess of one of the two corner blocks engages the engaging recess of the other one of the two corner blocks.

6. The travel cot of claim 1, wherein:

the lower sleeve of each of the corner blocks has an interior provided with a slideway connected to the mounting hole; and each of the support legs of the frame unit is slidable in the slideway of the lower sleeve.

7. The travel cot of claim 1, wherein:

the clamping plate of each of the articulation units is provided with a protruding portion extending outward; and the hooked piece of each of the articulation units is hooked on the protruding portion of the clamping plate.

8. The travel cot of claim 1, wherein:

the mounting stud of each of the articulation units aligns with the through hole of the positioning plate; and the positioning hole of the movable plate of each of the articulation units aligns with the receiving hole of the mounting stud.

9. The travel cot of claim 1, furthering comprising a covering unit mounted on the frame unit.

10. The travel cot of claim 9, wherein the covering unit includes:

a cloth enclosure enclosed in the frame unit;

a brim mounted on an upper end of the cloth enclosure;

a zipper mounted on a distal end of the brim; and four binding cords mounted on a lower end of the cloth enclosure and connected with the support legs of the frame unit.

* * * * *